US006349074B1

(12) United States Patent
Kim

(10) Patent No.: US 6,349,074 B1
(45) Date of Patent: Feb. 19, 2002

(54) ALARM SYSTEM FOR DESKTOP CLOCK

(76) Inventor: Bak Jo Kim, Hak-ik-Dong, 136-1 Jae-un Villa, 1 Dong 101, Inchon (KR)

( * ) Notice: Subject to any disclaimer, the term of this patent is extended or adjusted under 35 U.S.C. 154(b) by 0 days.

(21) Appl. No.: 09/712,936

(22) Filed: Nov. 16, 2000

(30) Foreign Application Priority Data

Feb. 16, 2000 (KR) ..... 00-4122

(51) Int. Cl.[7] ..... G04B 23/02; G04C 21/00
(52) U.S. Cl. ..... 368/73; 368/261; 368/263
(58) Field of Search ..... 368/72–74, 250, 368/252, 261–263

(56) References Cited

U.S. PATENT DOCUMENTS 1,967,995 A * 7/1934 Schlenker ..... 368/261
2,044,543 A * 6/1936 Putnam ..... 368/261

* cited by examiner

*Primary Examiner*—Vit Miska
(74) *Attorney, Agent, or Firm*—Nath & Associates PLLC; Gary M. Nath; Roger C. Hahn

(57) ABSTRACT

The present invention relates to an alarm system for a desktop clock capable of generating an audio alarm in the form of, for example, a voice message or the sound of running water at a preset wake-up or retiring time. More particularly, the invention relates to an alarm system for a desktop clock provided with an improved wake-up time indicating alarm unit on the main body, in which an hour hand alarm connecting gear wheel and a minute hand alarm connecting gear wheel are separately provided to facilitate the user's manipulation of the time setter on the casing in setting the wake-up and retiring time indication hands to a desired call time, thereby generating an audio alarm that reminds the user in a timely manner of the retiring time and a snooze time period of less than one hour, as well as the wake-up time.

20 Claims, 6 Drawing Sheets

ALARM SYSTEM FOR DESKTOP CLOCK

The present invention relates to an alarm system for a desktop clock capable of generating an audio alarm in the form of, for example, a voice message or the sound of running water at a preset wake-up or retiring time. More particularly, the invention relates to an alarm system for a desktop clock provided with an improved wake-up time indicating alarm unit on the main body, in which an hour hand alarm connecting gear wheel and a minute hand alarm connecting gear wheel are separately provided to facilitate the user's manipulation of the time setter on the casing in setting the wake-up and retiring time indication hands to a desired call time, thereby generating an audio alarm that reminds the user in a timely manner of the retiring time and a snooze time period of less than one hour, as well as the wake-up time.

In the mechanism of the conventional alarm system for desktop clocks, as the user rotates and manipulates an alarm time setter, a gear wheel fixedly associated with the alarm time setter is actuated to rotate both a gear wheel connected to a wake-up time indication hand and an hour hand gear wheel in the one direction. The hour hand gear wheel in turn rotates a minute hand gear wheel to set a predetermined call time. When the preset call time is reached, the stopper of the alarm gear wheel gets out of the groove of the hour hand gear wheel to raise both the hour hand gear wheel and the minute hand gear wheel. As a result of this, the contact of the minute hand gear wheel connects with that of a power terminal connected electronically to an alarm buzzer to generate an alarm sound. The alarm system is provided with an alarm switch on the move of the timepiece, particularly, an alarm on/off selection switch or a push-bottom which is provided on the front side, backside or topside of the casing of the desktop clock. Such conventional alarm systems mostly have a single function to generate, sometimes in an untimely manner, an alarm sound at a predetermined wake-up call time as preset by the user and disturb the surrounding people with an annoying alarm sound for a long time.

Furthermore, the convention alarm systems sometimes miss the preset call time so that those users not in the habit of sleeping a sound sleep at a predetermined time such as students preparing an examination, children and workers may have a lack of sleeping hours and suffer from fatigue and bad health.

SUMMARY OF THE INVENTION

It is the objective of the present invention to solve the problems of the previous type and to provide a novel alarm system for a desktop clock which is provided with a retiring time indicating alarm unit and a snooze time indicating alarm unit to set a snooze period of less than one hour with modified audio alarm generating and electrical connecting structures, in contrast to the arrangement of the conventional desktop clock which only has a time indicating and alarm ringing function using the operation of an oscillator connected to a circuit board with the power on.

To achieve the objective of the present invention, there is provided an alarm system for a desktop clock including: a retiring time rotatable gear wheel inserted into the casing of the desktop clock; a wake-up time rotatable gear wheel inserted in the casing of the desktop to be coaxially rotated with the retiring time gear wheel; a retiring time indication hand fixedly inserted in the axial top end of the retiring time gear wheel; a first intermediate gear wheel; an hour hand alarm connecting gear wheel having the same number of toothed gears as the retiring time gear wheel, wherein the first intermediate gear wheel and the hour hand alarm connecting gear wheel are sequentially geared with the retiring time gear wheel; an hour hand gear wheel; a second intermediate gear wheel; an hour hand alarm ringing gear wheel having twice as many toothed gears as the hour hand gear wheel, wherein the second intermediate gear wheel and the hour hand alarm ringing gear wheel are sequentially geared with the hour hand gear wheel; a third intermediate gear wheel; a minute hand alarm connecting gear wheel having the same number of toothed gears as the wake-up time gear wheel, wherein the third intermediate gear wheel and the minute hand alarm connecting gear wheel are sequentially geared with the wake-up time gear wheel; a minute hand gear wheel; a fourth intermediate gear wheel; a minute hand alarm ringing gear wheel, having with the same number of toothed gears as the minute hand gear wheel, wherein the fourth intermediate gear wheel and the minute hand alarming gear wheel are sequentially geared with the minute hand gear wheel; a power interrupter provided on each backside of the wake-up time gear wheel, the hour hand alarm connecting gear wheel and the minute hand alarm connecting gear wheel; inner and outer connection rings made of separately conducting materials and provided on each backside of the wake-up time gear wheel, the hour hand alarm connecting gear wheel and the minute hand alarm connecting gear wheel; a parabolic-shaped connection terminal fixedly provided on each front side of the hour hand gear wheel, the hour hand alarm ringing gear wheel and the minute hand alarm ringing gear wheel, the latter being arranged at a position corresponding to the power interrupter; a power source, having the positive terminal thereof connected to a buzzer and the negative terminal thereof, connected to the inner connection ring and a first terminal; and a second terminal connected to the buzzer and the outer connection ring. The alarm system is configured to generate an audio alarm from the buzzer exactly at a desired call time as preset by the user. The wake-up and retiring time setting knobs are designed to remind the user of the wake-up time as well as of the retiring time and a snooze time period of less than one hour.

DETAILED DESCRIPTION

Figure 1:
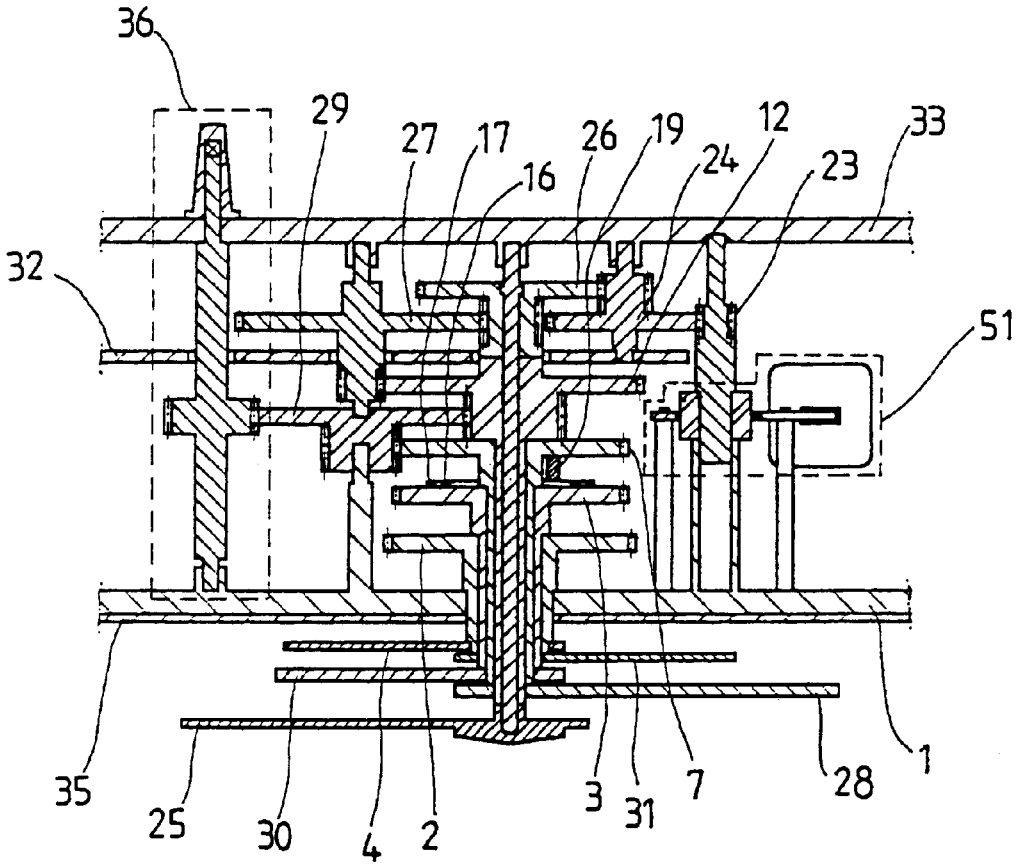
FIG. 1 is a cross-sectional view showing the arrangement of a conventional desktop clock in which a retiring time gear wheel is associated with a retiring time indication hand.
Figure 2:
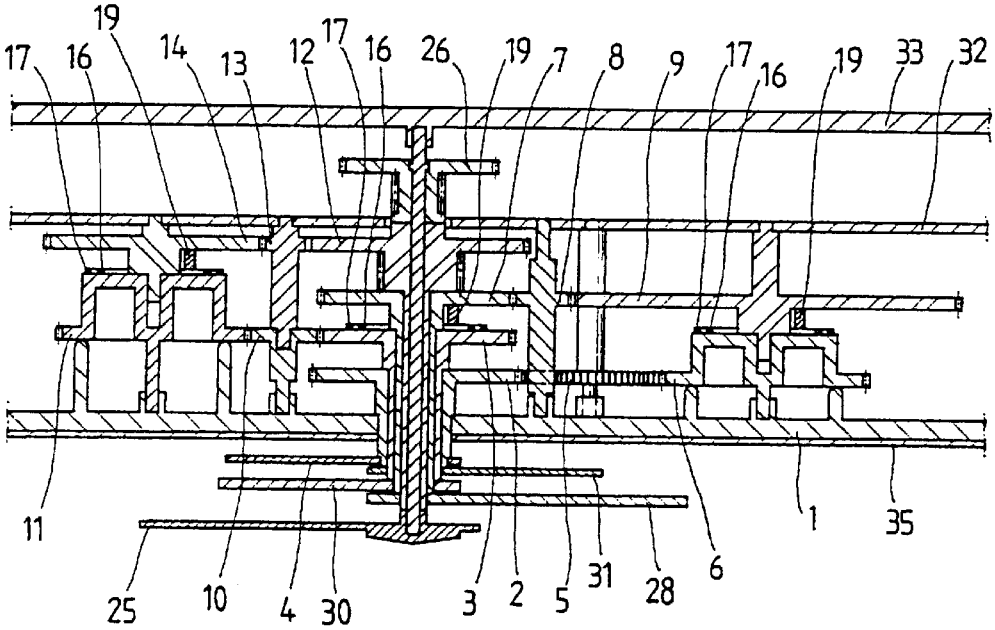
FIG. 2 is a cross-sectional view showing the principal part in an arrangement according to the present invention.
Figure 3A:
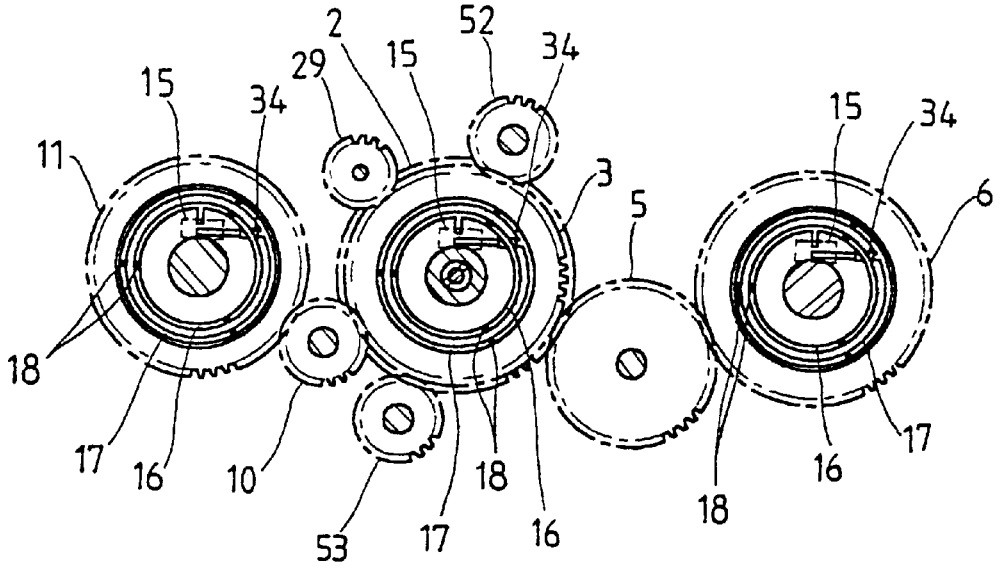
FIG. 3*a* is a cross-sectional view showing the principal part of he present invention with which inner and outer connection rings are incorporated.
Figure 3B:
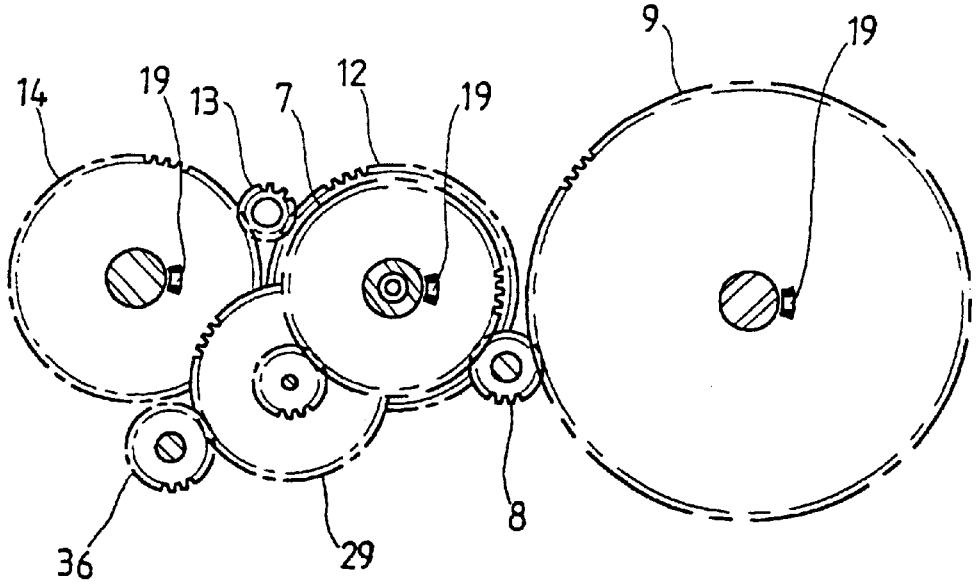
FIG. 3*b* is a cross-sectional view showing the principal part of the present invention in which the connection terminals are incorporated.
Figure 4:
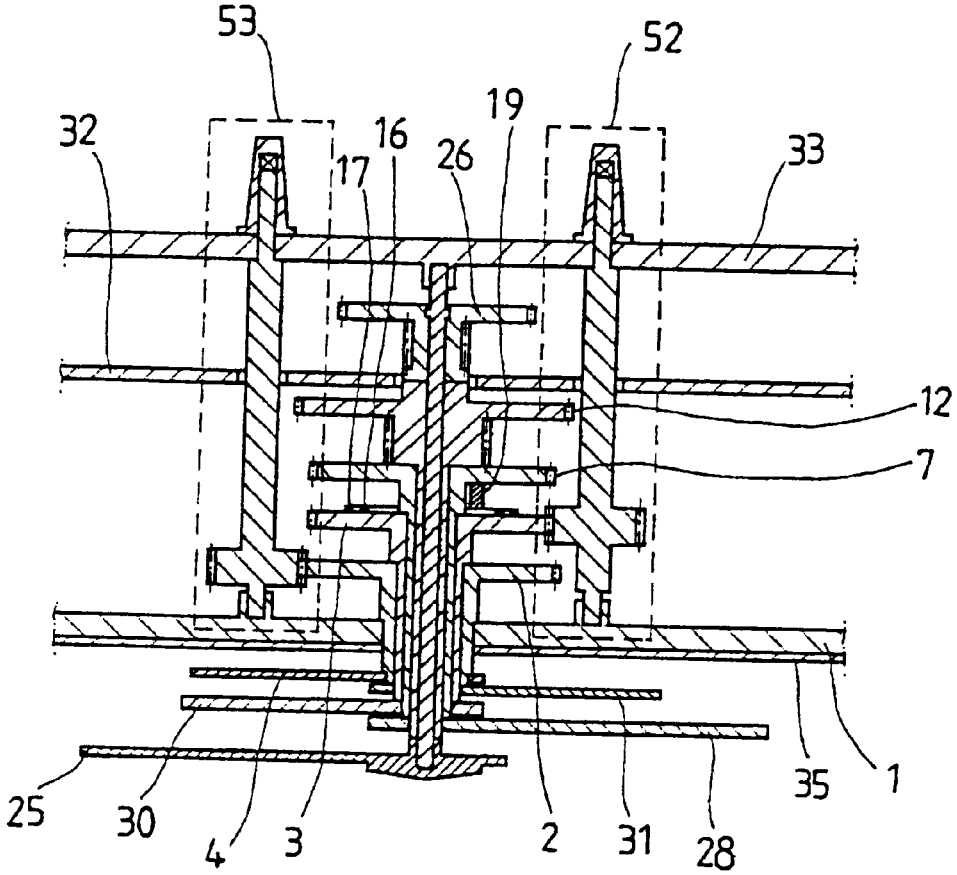
FIG. 4 is a cross-sectional view showing the arrangement of the present invention in which wake-up and retiring time setters are incorporated.
Figure 5:
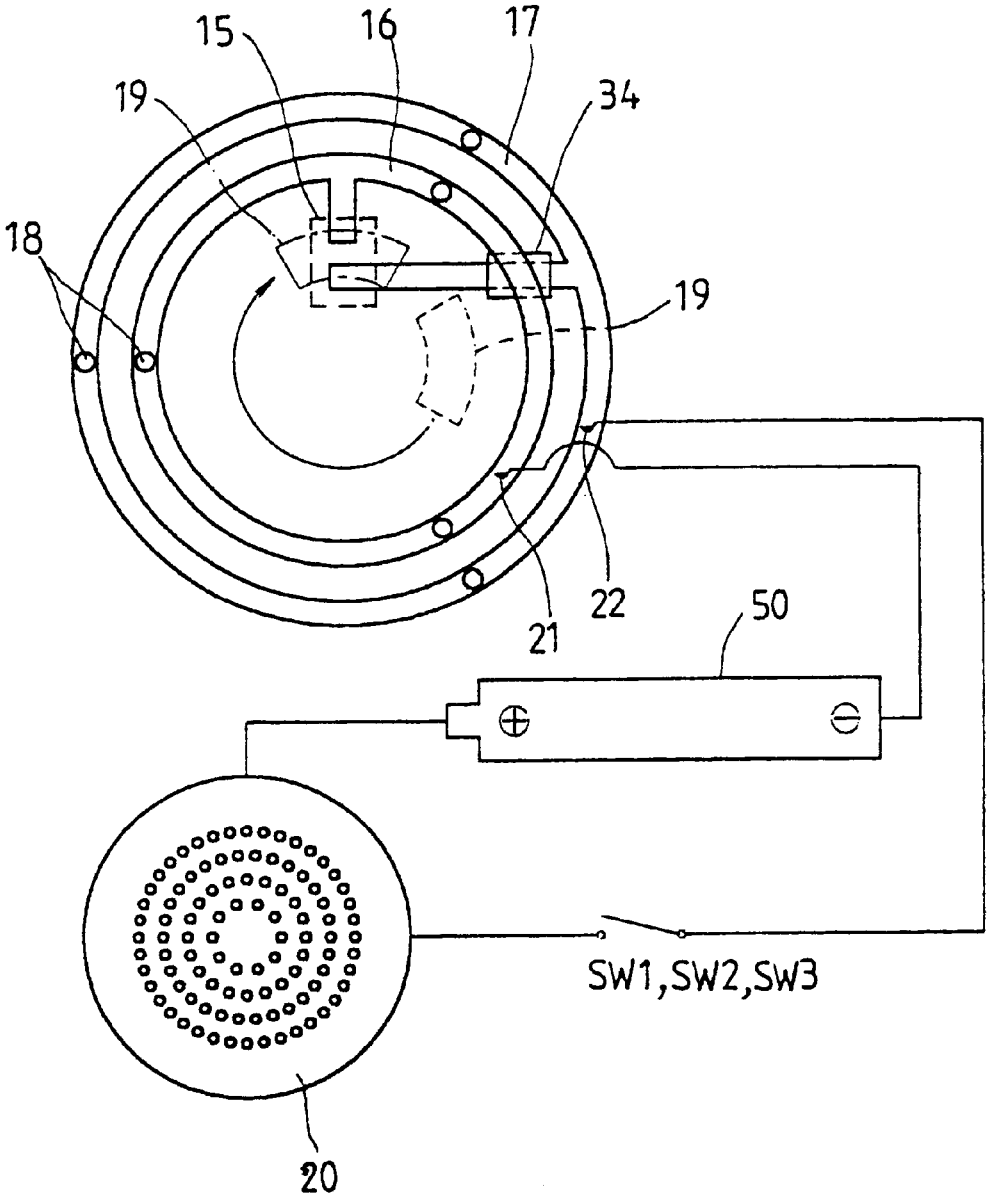
FIG. 5 is a wiring diagram showing the electrical arrangement of the alarm system according to the present invention.
Figure 6:
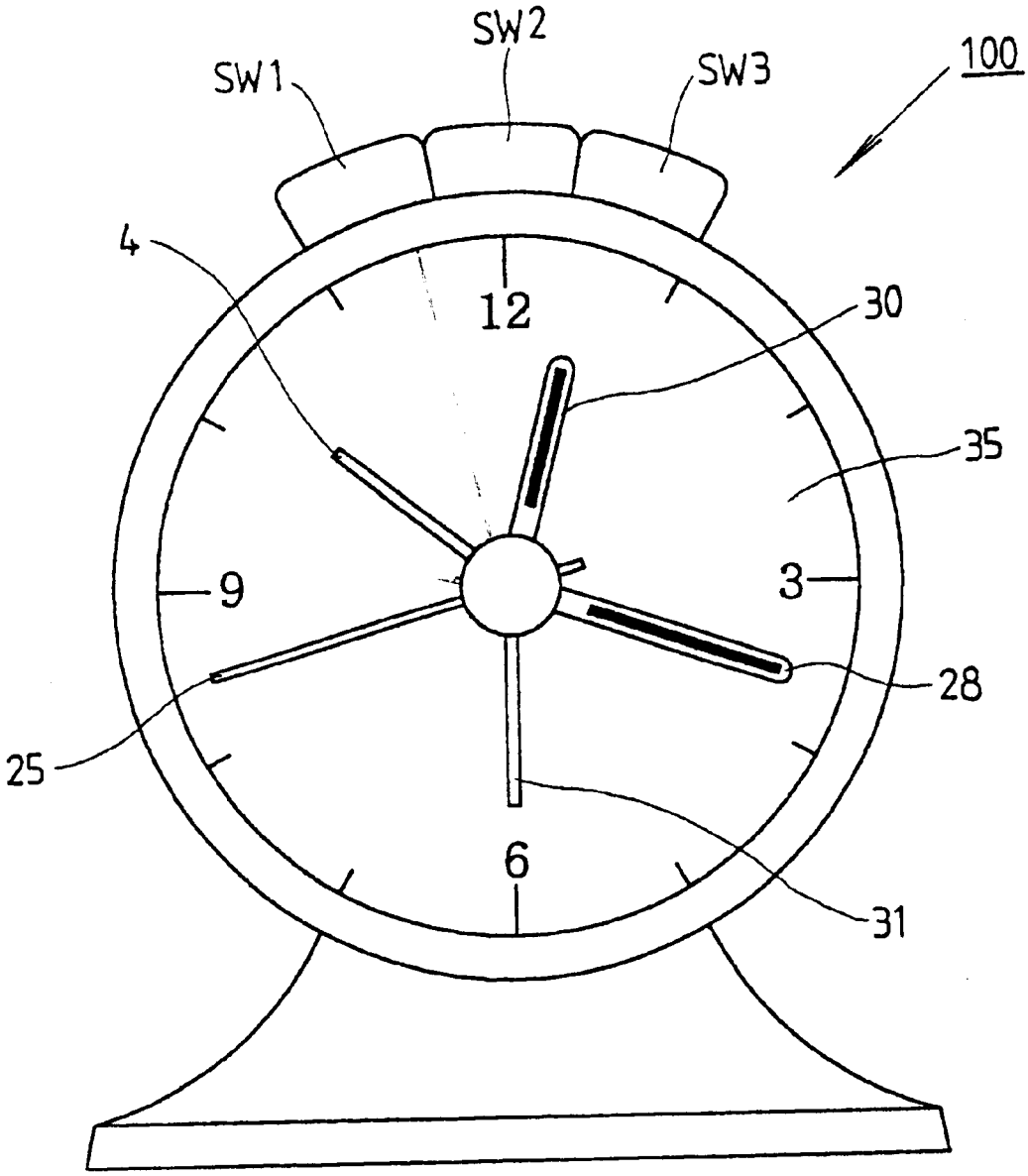
FIG. 6 is a front view of the alarm system in use according to the present invention.

Hereinafter, the present invention will be described in detail with reference to the accompanying drawings.

The mechanism of the performing time indication and alarm functions in a desktop clock 100 is activated as an oscillator 51 connected to a circuit board (not shown) which in turn is actuated with a power supply 50 on. In the mechanism, a retiring time rotatable gear wheel 2 is inserted in the casing 1 of the desktop clock 100 and coaxially rotated with a wake-up time gear wheel 3, which is also rotatable and inserted into the casing 1. A retiring time indication hand 4 is fixedly inserted in the axial top end of the retiring time gear wheel 2 positioned on the outside of the casing 1. An intermediate gear wheel 5 and an hour hand alarm connecting gear wheel 6 are sequentially geared with the retiring time gear wheel 2 provided in the casing 1, the hour hand alarm connecting gear wheel 6 having the same number of toothed gears as the retiring time gear wheel 2. An intermediate gear wheel 8 and an hour hand alarm ringing gear wheel 9 are sequentially geared with the hour hand gear wheel 7. The hour hand alarm ringing gear wheel 9 has twice as many toothed gears as the hour hand gear wheel 7. Thus, the hour hand alarm ringing gear wheel 9 is geared with the intermediate gear wheel 8 of the hour hand gear wheel 7 is coaxially associated with the hour hand alarm connecting gear wheel 6. The latter is geared with the intermediate gear wheel 5 of the retiring time gear wheel 2. An intermediate gear wheel 10 and a minute hand alarm connecting gear wheel 11 are sequentially geared with the wake-up time gear wheel 3, the minute hand alarm connecting gear wheel 11 having the same number of toothed gears as the wake-up time gear wheel 3. An intermediate gear wheel 13 and a minute hand alarm ringing gearwheel 14 are sequentially geared with the minute hand gear wheel 12, the minute hand alarming gear wheel 14 being provided with the same number of toothed gears as the minute hand gear wheel 12. Thus, the minute hand alarm ringing gear wheel 14 is geared with the intermediate gear wheel 13 of the minute hand gear wheel 12 and is coaxially associated with the minute hand alarm connecting gear wheel 11 geared with the intermediate gear wheel 10 of the wake-up time gear wheel 3. A power interrupter 15 is provided on each backside of the wake-up time gear wheel 3, the hour hand alarm connecting gear wheel 6 and the minute hand alarm connecting gear wheel 11. Furthermore, the inner and outer connection rings 16 and 17 made of separately conducting materials are fixedly provided on the individual backsides by means of a plurality of fixing pins 18. A parabolic-shaped connection terminal 19 is provided on each front side of the hour hand gear wheel 7, the hour hand alarm ringing gear wheel 9 and the minute hand alarm ringing gear wheel 14, and arranged at a position corresponding to the power interrupter 15 of the inner and outer connection rings 16 and 17. As a result of this the power interrupter 15 is brought in contact with the power source at a preset call time. The power source 50 has the positive terminal and is connected to a buzzer 20 and the negative terminal is connected to the inner connection ring 16 and a terminal 21. Between the buzzer 20 and the outer connection ring 17 are connected ON/OFF switches SW1, SW2 and SW3, and a second terminal 22 which is connected to the buzzer 20 makes contact with the outer connection ring 17.

In the figures, the reference numeral 32 denotes a support board, the reference numeral 33 refers to a casing cover, the reference numeral 34 refers to an insulator (non-conductor), the reference numeral 36 is a time setter.

First, the principle of the operation of the conventional desktop clock will be described below prior to the description of the present invention. As an oscillator 51 connected to a circuit board (not shown) is activated with power 50 on, an oscillator rotatable gear wheel 23 actuates an intermediate gear wheel 24 and a second indication hand gear wheel 26 of which the axial top end has a second indication hand fixed therein. The second indication rotatable hand gear wheel 26 in turn actuates an intermediate gearwheel 27 and the minute hand gearwheel 12, of which the axial top end has a minute hand 28 fixed therein. The rotable minute hand gear wheel 12 also actuates an intermediate gear wheel 29 and an hour hand gear wheel 7 of which the axial top end has an hour hand 30 fixed therein. Thus, the desktop clock indicates the current time to the user. The arrangement of the wake-up time indicating alarm unit is the same as described in the previous type.

The present invention is similar to the related type in the arrangement of the wake-up time indicating alarm unit, wherein a wake-up time indication hand 31 is incorporated with the wake-up time gear wheel 3. However, the invention is provided with a retiring time indicating alarm unit and a snooze time indicating alarm unit to set a snooze period of less than one hour, in addition to the conventional alarm system with the audio alarm generating and electrical connecting structures modified, wherein the retiring time indicating alarm unit operates in a separate way from the snooze time indicating alarm unit. Now, a detailed description will be given of the operation of the present invention as follows.

Generally, a desired wake-up time is set within 12 hours in advance by means of the wake-up time indicating alarm unit of the present invention as in the conventional cases. As the user manipulates the wake-up time setter 52 to set a desired wake-up time, the wake-up rotatable time gear wheel 3 is actuated to rotate the wake-up time indication hand 31, which is fixedly inserted in the axial top end of the wake-up time gear wheel 3, thereby setting the wake-up time. At this time, the intermediate gear wheel 10 gearing the wake-up time gear wheel 3, and the minute hand alarm connecting gearwheel 11 are separately rotating in the clockwise or counter-clockwise direction depending on the turning direction of the wake-up time setter 52. When the preset wake-up time is reached, while the existing hour and minute hands are indicating the wake-up time, the connection terminal 19 on the front side of the hour hand gear wheel 7 is disposed at a position indicating the wake-up time and connects contact with the power interrupter 15 of the inner and outer connection rings 16 and 17 on the backside of the wake-up time gear wheel 3. Thus, the negative terminal of the power source 50 is activated by the ON signal of the on/off switch SW1 to generate an audio alarm from the buzzer 20 exactly at the desired wake-up time. In the meantime, the on/off switch SW2 is ON while the on/off switch SW3 is OFF.

Preferably, a desired retiring time of the retiring time indicating alarm unit is set within 24 hours in advance. As the user manipulates a retiring time setter 53 connected to the retiring time gear wheel 2 to set a desired retiring time, the rotatable retiring time gear wheel 2 is actuated by rotating the retiring time indication hand 4, which is fixedly inserted in the axial top end of the retiring time gear wheel 2, thereby setting the wake-up time. As such, the intermediate gear wheel 5 gearing the retiring time gear wheel 2, and the hour hand alarm connecting gear wheel 6 are separately rotated in a clockwise or counter-clockwise direction depending on the turning direction of the retiring time setter 53. When the preset retiring time is reached, with the existing hour and minute hands indicating the retiring time, the connection terminal 19 on the front side of the hour hand alarm ringing gear wheel 9 which has twice as many toothed gears as the hour hand gear wheel 7, connects with the power interrupter 15 of the inner and outer connection rings 16 and 17 on the backside of the hour hand alarm connecting gear wheel 6. Thus, the negative terminal of the power source 50 is activated by the ON signal of the on/off switch SW2 to generate an audio alarm from the buzzer 20 exactly at the desired retiring time. In the meantime, the on/off switches SW1 and SW3 are both in the OFF state.

Furthermore, the user can set the wake-up time indication hand 31 at a desired time of less than one hour for a snooze time period when he or she wants to extend the wake-up or retiring time or exercise for a time period of less than one hour. After the preset time period elapses, the connection terminal 19 on the front side of the minute hand alarm ringing gear wheel 14 is positioned at the minute-scaled time position and connects with the power interrupter 15 of the inner and outer connection rings 16 and 17 which are provided on the backside of the minute hand alarm connecting gear wheel 11. Then, the negative terminal of the power source 50 is activated by the ON signal of the on/off switch SW3 to generate an audio alarm from the buzzer 20 exactly at the scheduled time. In the meantime, the on/off switches SW1 and SW2 are both in the OFF position. The on/off switches SW1, SW2 and SW3 are turned OFF automatically after the elapsing of the present time period depending on the length of the connection terminal 19 without any separate manual operation in a way that the connection terminal 19 gets separated from the power interrupter 15 of the inner and outer connection rings 16 and 17.

Though not illustrated in the figure, another characteristic of the present invention includes a wake-up time setter 52 associated with a minute hand alarm connecting gear wheel 11 and a retiring time setter 53 associated with an hour hand alarm connecting gear wheel 6. Such an arrangement has the following advantages: First, the user can adjust the wake-up time indication hand 31 and the retiring time indication hand 4 on the casing 1 of the desktop clock 100 to preset a desired call time. It is also possible to use the hour hand alarm connecting gear wheel 6 for gearing the retiring time gear wheel 2, and the minute hand alarm connecting gear wheel 11 for gearing the wake-up time gear wheel 3, without need of intermediate gear wheels 5 and 10 between the retiring time wheel 2 and the hour hand alarm connecting gear wheel 6 and between wake-up time gear wheel 3 and the minute hand alarm connecting gear wheel 11. The numbers of toothed gears of the intermediate gear wheels 5, 8, 10 and 13 and the gear wheels are variable depending on the installation position. The gear wheels other than the retiring time gear wheel 2, which include the wake-up time gear wheel 3, the hour hand gear wheel 7, the minute hand gear wheel 12 and the second indication hand gear wheel 26 which are associated with the center of the desktop clock 100, have an adjustable gearing position. The length of the connection terminal 19 can also be adjusted to change the time interval of the audio alarm generated from the buzzer 20. Among the on/off switches SW1, SW2 and SW3, the switch SW2 for turning on/off the audio alarm generated at a preset retiring time is dispensable. Furthermore, the user can select the audio alarm for indicating the retiring time as a low sound suitable for the user to fall sleep, such as a natural sound of breathing, running water, etc.

The present invention, the arrangement of which as described above has several advantageous effects: i.e., It generates an audio alarm exactly at a desired call time preset by the user with the wake-up and retiring time setting knobs to remind the user of the retiring time as well as the wake-up time; It enables the user to set a snooze time period of less than one hour in advance; It makes the operation mode of the alarm time indication hands distinguishable for more accurate use of the alarm function of the desktop clock; It emits a separate alarm sound in the alarm mode of the desktop clock to provide a convenient facility in using the alarm function; and it enables the user to be reminded of the exact retiring time, which forms a habit of falling asleep at the preset time naturally and of securing the necessary amount of sleeping hours.

What is claimed is:

1. An alarm system for a desktop clock comprising:

a casing;

a rotatable retiring time gear wheel inserted in the casing of the desktop clock;

a rotatable wake-up time gear wheel inserted in the casing of the desktop clock rotated with the retiring time gear wheel;

a retiring time indication hand cooperatively engaged with the retiring time gear wheel;

a means for providing an alarm; and a means for driving said rotatable retiring time and wake up time gears.

2. The alarm system as claimed in claim 1 wherein said wake-up time gear wheel is coaxially rotated with the retiring time gear wheel.

3. The alarm system as claimed in claim 2, wherein said means for driving said rotatable retiring time and wake up time gears is comprised of:

a first intermediate gear wheel; and an hour hand alarm gear wheel;

wherein the first intermediate gear wheel and the hour hand alarm gear wheel are sequentially geared with the retiring time gear wheel.

4. The alarm system as claimed in claim 3 wherein the hour hand alarm gear wheel has the same number of toothed gears as the retiring time gear wheel.

5. The alarm system as claimed in claim 3, further comprising a power interrupter on a backside of the hour hand alarm gear wheel.

6. The alarm system as claimed in claim 3, further comprising inner and outer connection rings of separate conductive material on a backside of the hour hand alarm gear wheel.

7. The alarm system as claimed in claim 1, wherein said means for driving said rotatable retiring time and wake up time gears is comprised of:

an hour hand gear wheel;

a second intermediate gear wheel;

wherein said means for providing an alarm is comprised of:

an hour hand alarm ringing gear wheel;

wherein the second intermediate gear wheel and the hour hand alarm ringing gear wheel are sequentially geared with the hour hand gear wheel.

8. The alarm system as claimed in claim 7 wherein the hour hand alarm ringing gear wheel has twice as many toothed gears as the hour hand gear wheel.

9. The alarm system as claimed in claim 7, further comprising a connection terminal fixedly provided-on a front side of the hour hand gear wheel arranged at a position corresponding to a power interrupter.

10. The alarm system as claimed in claim 7, further comprising a connection terminal fixedly provided on a front side of the hour hand alarm ringing gear wheel arranged at a position corresponding to a power interrupter.

11. The alarm system as claimed in claim 1, wherein said means for driving said rotatable retiring time and wake up time gears is comprised of:

a third intermediate gear wheel; and a minute hand alarm gear wheel;

wherein the third intermediate gear wheel and the minute hand alarm gear wheel are sequentially geared with the wake-up time gear wheel.

12. The alarm system as claimed in claim 11, wherein the minute hand alarm gear wheel has the same number of toothed gears as the wake-up time gear wheel.

13. The alarm system as claimed in claim 11, further comprising a power interrupter on a backside of the minute hand alarm gear wheel.

14. The alarm system as claimed in claim 11, further comprising inner and outer connection rings of separate conductive material on a backside of the minute hand alarm gear wheel.

15. The alarm system as claimed in claim 1, wherein said means for driving said rotatable retiring time and wake up time gears is comprised of:

a minute hand gear wheel;

a fourth intermediate gear wheel; and a minute hand alarm ringing gear wheel;

wherein the fourth intermediate gear wheel and the minute hand alarm ringing gear wheel are sequentially geared with the minute hand gear wheel.

16. The alarm system as claimed in claim 15, wherein the minute hand alarm ringing gear wheel has the same number of toothed gears as the minute hand gear wheel.

17. The alarm system as claimed in claim 15, further comprising a connection terminal fixedly provided on a front side of the minute hand alarm ringing gear wheel arranged at a position corresponding to a power interrupter.

18. The alarm system as claimed in claim 1, wherein said means for providing an alarm is comprised of a power interrupter on a backside of the wake-up time gear wheel.

19. The alarm system as claimed in claim 18, further comprising inner and outer connection rings of separate conductive material on a backside of the wake-up time gear wheel.

20. The alarm system as claimed in claim 19, further comprising:

a power source having two terminals;

wherein said means for providing an alarm is comprised of:

an audible signal device;

wherein a first terminal of said power source is connected to a first terminal of said audible signal device and a second terminal of said power source is connected to a first contactor terminal in contact with said inner connection ring; and a second terminal of said audible signal device is connected to a second contactor terminal in contact with said outer connection ring.

* * * * *